United States Patent [19]

Olivieri

[11] 4,132,424

[45] Jan. 2, 1979

[54] DEVICE FOR REMOVABLY CLAMPING A SKATE TO THE SOLE OF A SKATING SHOE

[75] Inventor: Icaro Olivieri, Treviso, Italy

[73] Assignee: ICESLJ AG, Vaduz, Liechtenstein

[21] Appl. No.: 803,188

[22] Filed: Jun. 3, 1977

[30] Foreign Application Priority Data

Jun. 4, 1976 [CH] Switzerland ..... 7102/76

[51] Int. Cl.[2] ..... B60K 27/00

[52] U.S. Cl. ..... 280/11.3

[58] Field of Search ..... 280/11.3, 11.31, 11.32, 280/11.33, 11.34, 11.12, 11.1 R

[56] References Cited

U.S. PATENT DOCUMENTS 908,536 1/1909 Arlund ..... 280/11.3

3,243,191 3/1966 Weisman ..... 280/11.12

*Primary Examiner*—Joseph F. Peters, Jr.
*Assistant Examiner*—Gene A. Church
*Attorney, Agent, or Firm*—Sughrue, Rothwell, Mion, Zinn and Macpeak

[57] ABSTRACT

A skate blade is fastened to the sole of a skating shoe by means of a screw which extends from inside the shoe through aligned apertures in a recessed washer, the sole of the shoe, the skate blade attaching plate, a body of elastically deformable material located in a hollow support disposed between the plate and the blade and a nut secured to said elastically deformable material. A similar screw nut arrangement is provided at the heel of the skate.

2 Claims, 5 Drawing Figures

DEVICE FOR REMOVABLY CLAMPING A SKATE TO THE SOLE OF A SKATING SHOE

The present invention concerns a device for clamping a skate to the sole of skating footwear, for example, shoes, small boots, top boots, ankle boots and similar conventional footwear.

A skate usually consists of a blade, longitudinally fixed to an elongated tubular body which supports, by means of at least a pair of hollow spacers, a shaped plate, destinated to be fixed to a skating shoe. This plate may be in one piece but, more usually, consists of two parts, one to be fixed to the sole and one to be fixed to the heel of the said shoe. In another type of skate, the plates to be fixed to the sole and the heel of the said shoe are substituted by flanged edges moulded onto the said hollow spacers.

In order to obtain a satisfactory skate-shoe unit, the plates or flanged edges must be joined to the sole-heel in such a way that the said skate-shoe unit is in practice a monolithic unit in order to withstand the considerable points of stress which frequently occur in this joint when the shoes are in use.

Until now such joining has been effected by riveting a plurality of rivets, previously inserted into a corresponding plurality of holes made respectively in the sole of the shoe and in the plate (or flanged edges) of the skate.

However satisfactory such joining may be in acheiving the above mentioned requirement, it presents both technical and economic difficulties which have until now remained unsolved. This in fact requires a whole series of preliminary operations to be carried out on the shoe and on the skate, as well as the use of special equipment, operated by skilled personnel. Furthermore, when it is necessary to replace the skate or the shoe, the said joining, which is a fixed joining, always requires the use of special equipment and the services of skilled personnel to make the necessary separation and, following the separation, the reconstruction of a new skateshoe unit.

This invention stems from the problem of making a device for clamping a skate to the sole of a shoe, having structural and functional characteristics to overcome the difficulties cited above, at the same time, guaranteeing the desired monolithicity of the skate-shoe unit thus obtained.

In accordance with the invention, this problem is resolved by the fact that the said device consists of at least two removeable essentially screw-nut clamping units, the nut of each clamping unit being positioned in a corresponding hollow spacer, the screw of each unit being engaged in a freely rotatable manner in holes made in the sole and in the plate coaxially with the said hollow spacer.

Advantageously each clamping unit comprises a body of elastically deformable material, positioned in a corresponding hollow support and traversed by a hole axially aligned with the said holes formed in the sole and in the plate, a flanged nut being coaxially connected, by a method known per se, to the said body and to that part of it which is furthest from the corresponding plate.

In accordance with the third characteristic of the invention, the said elastically deformable body consists of a protuberance formed on the said sole when the said sole is of a type made from moulded rubber, plastics of like material.

The advantages acheived by the invention are mainly concerned with the fact that the clamping of a skate to the sole of a respective shoe to obtain a monolithic unit is attainable by means of the simple and quick operation of screwing up a couple of screws without the use of special equipments and without requiring any special skill, and with the fact that, by an equally simple unscrewing operation, the said clamping may be removed, separating the skate from the shoe, in order, for example, to replace one of the two components of the said unit with a new one. Clearly, these operations may easily be carried out, to great advantage, by the skater himself. Another considerable advantage lies in the economy of clamping skate to shoe by means of the device of this invention as opposed to the traditional and conventional riveting. In fact it eliminates the numerous drilling operations either of the metal plates or flanged portions of the hollow spacers, or of the sole, the insertion of a rivet in each pair of opposing holes and then the riveting of all the rivets.

Further characteristics and advantages of the invention will become more apparent from the description of some examples of embodiments of a device in accordance with the invention, which appears below by way of illustration, with reference to the attached drawings, in which.

Figure 1:
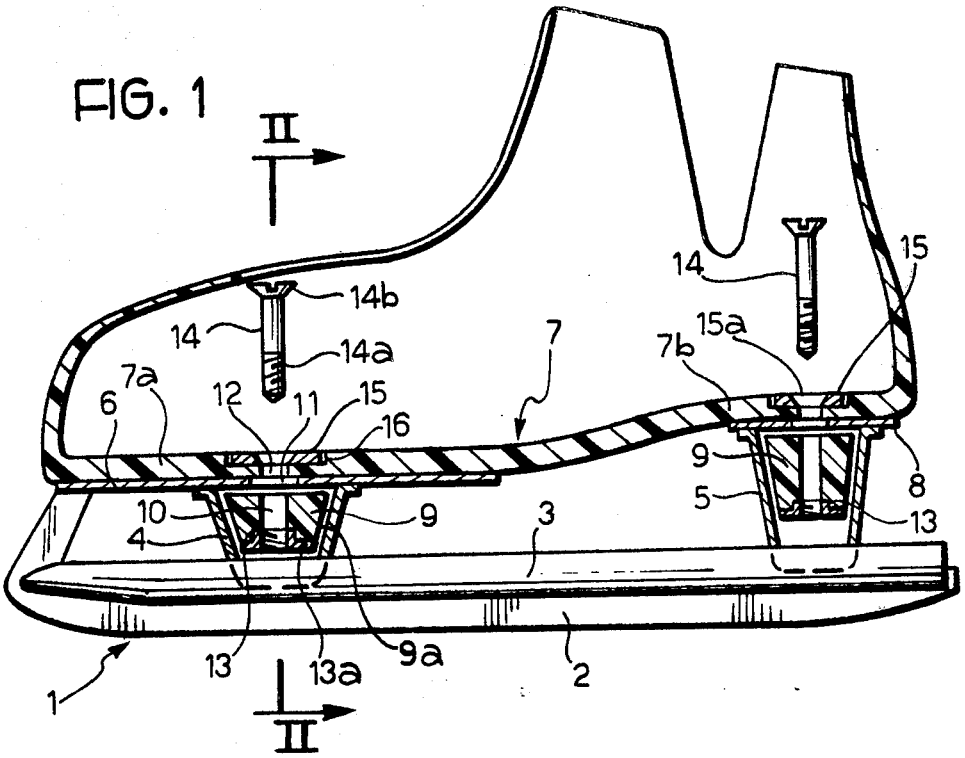
FIG. 1 is a longitudinal cross-section of a skate-shoe unit using a device in accordance with the invention.
Figure 2:
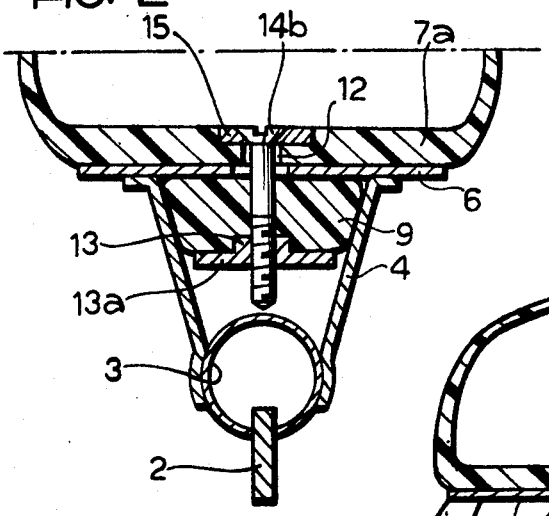
FIG. 2 is a cross-section on an enlarged scale along the line II—II of FIG. 1.

With reference to FIGS. 1 and 2, reference 1 shows generally a skate essentially comprising a blade 2 longitudinally fixed by conventional method to an elongate tubular body 3, to which are also fixed, again conventionally, the smaller ends of two hollow frusto conical spacers 4,5 the concavity of which is turned towards the tubular body 3. Above the spacer 4 there is welded a metal plate 6 to be fixed, in the manner previously described, to the front portion 7*a* of the sole 7 of a skating shoe, whilst above the spacer 5 there has been welded a metal plate 8, to be fixed to the heel portion 7*b* of the said sole 7. In the Figures of the attached drawing, the said sole 7 is in fact a sole body, made by the usual methods for moulding an appropriate plastics material.

For the purpose of clamping the said sole 7 to the plates 6, 8 of the skate 1, clamping devices are used in accordance with the invention. To avoid complication, the description which follows is made with reference to just one of these, that is to the device used for the clamping of the portion 7*a* of the said sole to the front plate 6 of the skate 1, the entire description being equally applicable to the device for clamping the heel 7*b* to the rear plate 8 of the skate.

According to a first construction, the clamping device in accordance with the invention comprises a body 9, of elastically deformable material, for example a rubber or a suitable plastics material the rigidity of which may be pre-established, lodged inside the hollow spacer 4 prior to the plate 6 being fixed, for example by welding, above this. The said body 9, which will preferably have the same frustoconical shape as the hollow spacer 4 in which it is lodged, but smaller dimensions than those of the said spacer, is traversed axially by a hole 10 which is aligned with a hole 11 formed in the plate 6 and a hole 12 formed in the portion 7a of the said sole 7.

At the end 9a of the said body 9 which is furthest away from the plate 6 there is coaxially joined, by a method which is itself well-known and is not illustrated, a nut 13 provided with a plate-like flange 13a of predetermined transverse dimensions. The device also comprises a screw 14, having an end portion 14a which is threaded in order to be screwed into the nut 13; the head 14b of the said screw is designed to bear against the portion 7a of the sole 7. When the screw 14 is inserted in the aforementioned aligned holes 10, 11 and 12 and deeply screwed into the nut 13, the desired clamping of the skate 1 to the sole 7 is achieved. In fact, the engagement between the screw 14 and the nut 13 is of the lead-screw coupling type with the result that by deeply screwing, the screw 14 produces the approaching of the nut 13 to the plate 6 while at the same time causes the elastically deformable body 9 to be compressed. As this body becomes deformed it urges against the lateral surface of the spacer 4 and against the surface of the plate 6, having a strong stabilizing effect on the achieved clamping. For a better distribution of the stresses, the head 14b of the screw bears against a small plate 15 which is traversed by a hole 15a and lodged in a special seat 16 made in the portion 7a of the sole 7 around the through hole 12.

This clamping system has been used in the manufacture of ice-hockey boots and it was possible to establish that the skate-shoe unit maintains perfectly the desired monolithicity even when points of stress, which are notoriously high, occur, as exerted on the clamping when said sport is in progress.

By a equally simple and speedy operation of unscrewing the screws 14 from the respective nuts 13, the skate 1 can be separated from the respective shoe and this operation is facilitated by the body 9 which, elastically, reassumes its former shape. This separation may be effected when the skate is in need of repair, (for example, for sharpening the blade 2 of the skate) whereby it must be replaced by another with the same characteristics, or when the skater wishes to fit to the same shoe skates of different characteristics, corresponding to different ice sports, for example when he wishes to replace an ice-hockey skate with one for speed skating, distance skating or figure skating. The clamping, separating and replacement operations described above may clearly be carried out by the skater himself, no special skill or special equipment being required.

Figure 3:
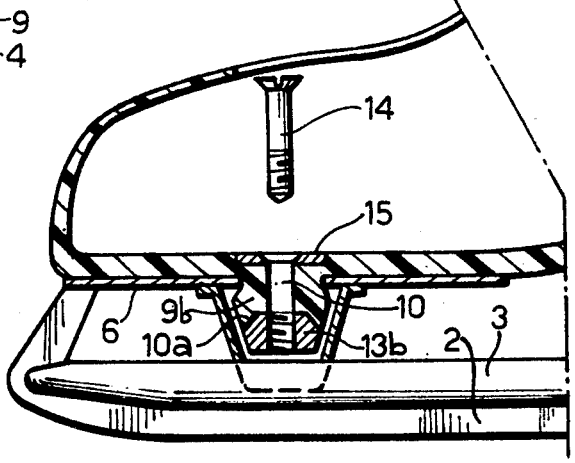
FIG. 3 is a longitudinal cross-section of the front part of a skate-shoe unit using a device in accordance with the invention and according to a first modified construction.

In the modified construction illustrated in FIG. 3, each elastically deformable body is a protuberance 9b integral with the sole or heel portion 7a or 7b of the skating shoe.

This construction is particularly convenient when the upper and the sole are made as an integral body, by moulding of an adequate plastics or rubber material. In this construction the protuberance 9b is axially provided with a recess 10a of frusto-conical shape, tapering towards the sole 7, in which recess is lodged a conical nut 13b used for the compression and expantion of said protuberance 9b in the manner described above with reference to the body 9.

In other cases it was possible to establish that the clamping together of the sole and the skate yielded more than satisfactory results, using devices such as those previously described with reference to FIGS. 1 and 2 but without the elastically deformable body 9. In this case, the advantageous effect which had previously been produced by the elastically deformable body 9 on the occasion when the two components of the skate-shoe unit were clamped together or separated, is assigned to the deformability of the sole 7 of the said shoe which is made of an appropriate material.

Figure 4:
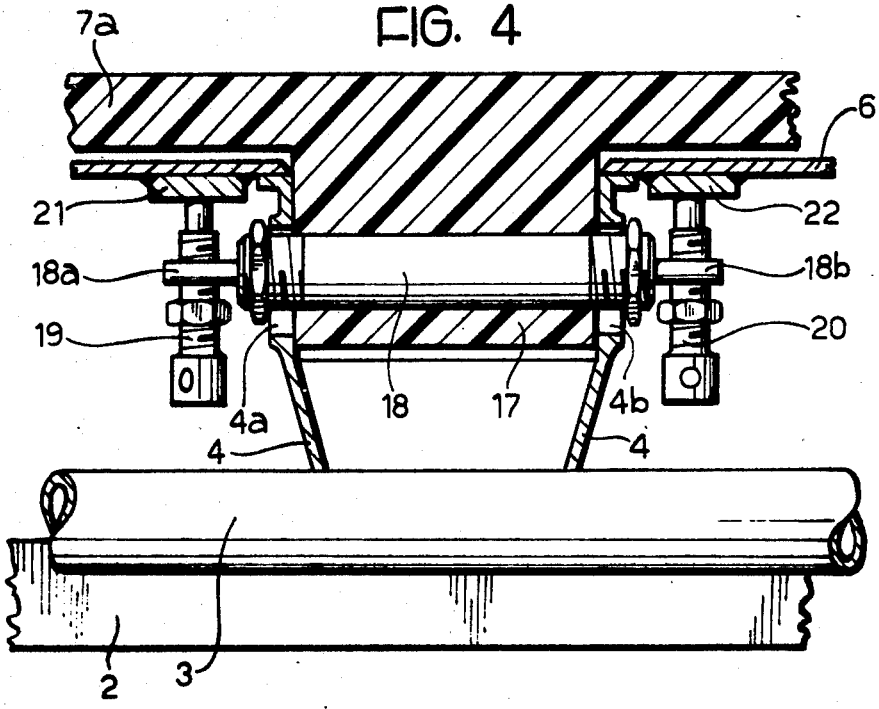
FIGS. 4 and 5 are cross-section on an enlarged scale of further modified constructions of a device according to this invention.

FIG. 4 represents a further modified construction of a device in accordance with the invention. To avoid complication, FIG. 4 and the description which follows refer to the joint between the portion 7a of the sole 7 and the skate 1, it being understood that the said joint, with all that it entails, is also used for the clamping of the heel 7b of the said sole with the skate 1. The portion 7a of the sole is provided, corresponding to the hollow spacer 4, with a protuberance 17, having the appropriate shape and dimensions to be inserted with male-female type interengagement into such spacer. A cylindrical pin 18 is radially inserted through openings 4a, 4b made in the spacer 4 in diametrically opposite positions, and through the said protuberance 17. The end portions of the said pin 18, which protrude from the sides of the spacer 4, are provided respectively with flanges 18a, 18b into which the corresponding screws 19, 20 are inserted, so that these may then press against the plate 6, preferably with the interposition of reinforcing transverse members 21, 22.

In order to enable the pin 18 to move parallel to itself during the clamping together and separating of the skate 1 and the sole of the shoe in question by means of the device described above, the holes 4a, 4b through which the pin 18 is inserted are in the shape of buttonholes elongated in the direction perpendicular to the plate 6.

Figure 5:
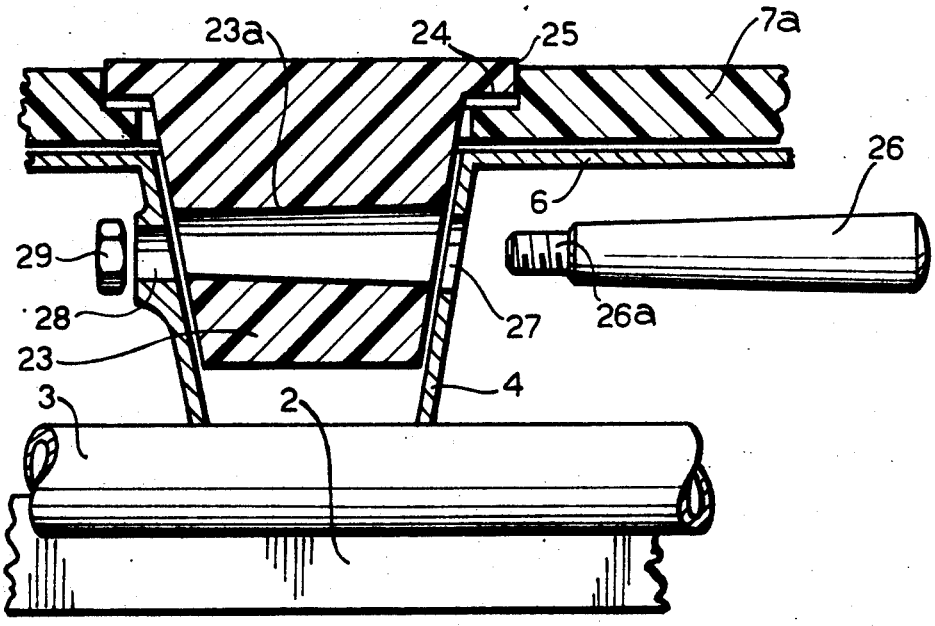

In the modified construction of FIG. 5, for the clamping of the portion 7a of the sole and the skate 1, there has been used a body 23, which is independent of the sole itself and has the appropriate shape and dimensions to be inserted, with male-female type coupling, into the hollow spacer 4. The said body 23 is provided, at the end opposite that which is to be inserted into the spacer 4, with an edgeflange 24, designed to rest on the flat bottom of a seat 25 made in the said portion 7a of the sole. The clamping together is achieved by the use of a conical pin 26 provided with a threaded tang 26a, this pin being inserted through openings 27, 28 made in the spacer 4 in diametrically opposite positions, and through a conical hole 23a, diametrically positioned in the said body 23. The clamping is accomplished by insertion of the pin 31 in the male-female coupling between the body 23 and the spacer 4 and by means of screwing a nut 29 onto the threaded tang 26a of said pin.

What claim is:

1. A device for clamping a skate to the sole of a skating shoe, said skate being of the type comprising a blade longitudinally fixed to an elongated tubular body which supports by means of at least two hollow spacers plate means adapted to be fixed to the skating shoe, said device comprising a body of elastically deformable material positioned in each of said hollow spacers and traversed by a hole which extends perpendicular to said plate means, at least two removable screw-nut clamping units, the nut of each clamping unit being fixed to said body of elastically deformable material in alignment with said hole at the end thereof farthest from said plate means, the screw of each clamping unit being inserted in freely rotatable condition in holes extending through the sole and in the plate in alignment with the hole in said body within the respective hollow spacer, said screw of each unit having a head which bears upon the sole through an intermediate small perforated plate lodged in a respective seat made in the sole in alignment with said holes.

2. A device as set forth in claim 1, wherein said elastically deformable body is comprised of a protuberance which is of integral one piece construction with the sole.

* * * * *